United States Patent [19]

Galliet

[11] Patent Number: 5,075,964

[45] Date of Patent: Dec. 31, 1991

[54] METHOD OF MAKING A COOLING FAN ROTOR FOR A ROTATING ELECTRICAL MACHINE IN PARTICULAR FOR AN ALTERNATOR FOR AN AUTOMOTIVE VEHICLE

[75] Inventor: Michel Galliet, Sucy-en-Brie, France

[73] Assignee: Valeo Equipements Electriques Moteur, Creteil, France

[21] Appl. No.: 665,668

[22] Filed: Mar. 7, 1991

[30] Foreign Application Priority Data

Mar. 8, 1990 [FR] France ..... 9002926

[51] Int. Cl.[5] ..... B23P 15/02

[52] U.S. Cl. ..... 29/889.4; 29/889.23; 72/379.2

[58] Field of Search ..... 29/889.23, 889.4; 72/379.2; 416/DIG. 3, 223 R, 223 B

[56] References Cited

U.S. PATENT DOCUMENTS

| | | | |
|---|---|---|---|
| 1,897,947 | 2/1933 | Howell | 416/187 |
| 2,690,151 | 9/1954 | House | 72/379.2 |
| 2,802,620 | 8/1957 | Darrah | 416/185 |
| 3,737,966 | 6/1973 | Ranz | 29/889.4 |
| 3,921,272 | 11/1975 | Klonoski | 29/889.4 |
| 4,329,118 | 5/1982 | Ranz | 29/889.4 |
| 4,741,194 | 5/1988 | Kozyra et al. | 72/379.2 |

*Primary Examiner*—Irene Cuda

*Attorney, Agent, or Firm*—Dennison, Meserole, Pollack & Scheiner

[57] ABSTRACT

A cooling fan rotor for a rotating electrical machine such as an alternator for an automotive vehicle, has n ventilating blades. The rotor is made by a method including the following steps:

an elongated metal strip is formed;

the metal strip is formed with 2n surface portions comprising first surface portions and second surface portions, each of generally quadrilateral shape; and the second quadrilateral surface portions are bent over on themselves successively or simultaneously, each about its median line, which is the line bisecting the angle defined by the sides of the said surface portion.

10 Claims, 3 Drawing Sheets

METHOD OF MAKING A COOLING FAN ROTOR FOR A ROTATING ELECTRICAL MACHINE IN PARTICULAR FOR AN ALTERNATOR FOR AN AUTOMOTIVE VEHICLE

FIELD OF THE INVENTION

The present invention relates to a method of making a cooling fan rotor for a rotating electrical machine, in particular for an alternator for an automotive vehicle. The invention equally relates to cooling fan rotors made by such a method.

BACKGROUND OF THE INVENTION

It is necessary to cool alternators of automotive vehicles, and similar machines while they are operating, so as to limit their operating temperature and so ensure optimum performance. Such cooling is usually obtained by a cooling fan comprising a rotor which gives forced ventilation through the machine. It is necessary that the inevitable increase in selling price resulting from the need to provide a cooling fan rotor in the machine should be as small as possible.

One of the known methods by which such cooling fan rotors are made is described especially in European published patent application No. EP 0 270 393A. In such a method, the first operation is to stamp out an approximately circular sheet metal blank having on its periphery the same number of teeth as there are to be fins or blades in the cooling fan. In a second operation these teeth are bent at right angles to the blank, so forming the cooling blades.

Although such a method allows cooling fan rotors to be made very cheaply, it nonetheless has certain drawbacks, notably that only a limited number of blades can be formed. In fact, the number of cooling blades which it is possible to obtain by this method depends on the length of the circumference of the sheet metal blank; and even if a sufficiently large number of blades can be formed in a machine of large diameter, this is not true where the diameter of the machine is small, as is the case for example in alternators for automotive vehicles. For these reasons, the working surface of the cooling fins is correspondingly limited.

It is possible to remedy these disadvantages to some extent, by giving the cooling fins or blades particular shapes such as to increase their performance, but these methods do inevitably lead to additional manufacturing operations which result in increased cost; and indeed, these operations are in any case often incompatible with mass production techniques.

DISCUSSION OF THE INVENTION

The present invention overcomes these disadvantages, and to that end it provides a method of making a cooling fan rotor, in particular for a rotating electrical machine, in which the cooling fan rotor is to have n cooling blades, characterised in that it includes the following steps:

an elongated metal strip is formed;

the said metal strip is formed with 2n surface portions, comprising first surface portions and second surface portions, each of generally quadrilateral shape; and the said second quadrilateral surface portions are bent over on themselves successively or simultaneously, each about its median line which is the line bisecting the angle defined by the sides of the said surface portion.

Preferably, each of the said second quadrilateral surface portions is in the form of a trapezium.

By using this method, it is possible to make a cooling fan rotor having an increased number of blades, because the number of blades depends only on the total size of those surface portions which are not bent. Similarly, the surface of the cooling blades can be increased, because this depends only on the total surface area of those surface portions which are bent.

A cooling fan rotor made by the above method in accordance with the invention offers cooling performance which can be perfectly adapted to the rotating electrical machines (such as automotive vehicle alternators) in which they are to be installed, and at a greatly reduced cost.

In addition, the method in accordance with the invention, as it will be further discussed below, enables non-radial blades, spaced apart circumferentially by different amounts, to be produced. This enables noise effects to be reduced in a particularly inexpensive manner.

The description which follows will give a better understanding as to how the invention may be carried out in practice. This description, of preferred embodiments of the invention, is given by way of example only and with reference to the accompanying drawings.

DESCRIPTION OF PREFERRED EMBODIMENTS OF THE INVENTION

Figure 1:
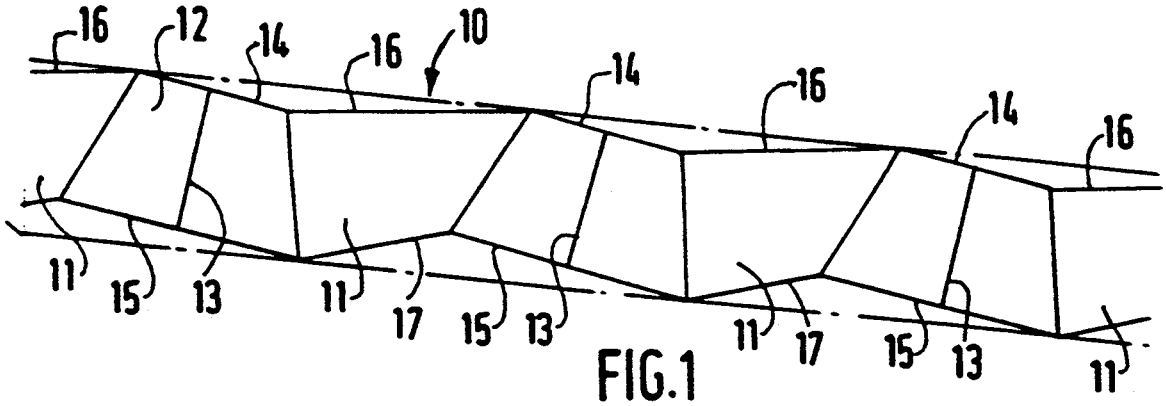
FIG. 1 is a partial top plan view of a strip of metal from which the cooling fan rotor in accordance with the invention is made.

The cooling fan rotor is made from a metal strip 10, which is shown partially in FIG. 1, and which has a rectangular shape indicated in FIG. 1 by phantom lines. The metal strip 10 is divided into 2 n quadrilateral surface portions, where n is the number of blades or fins with which the cooling fan rotor is to be provided. These surface portions comprise first quadrilateral surface portions 11 having outer edges 16 and 17, alternating with second quadrilateral surface portions 12, the latter being preferably trapezoidal in shape.

Each of the surface portions 12 has a median line 13 which is perpendicular to the outer edges 14 and 15 of the portions 10, the outer edges 14 and 15 being parallel to each other. As has been explained above, the median line 13 of each trapezoidal surface portion 12, in general, bisects the angle formed by the transverse lines which define the side edges of the surface portion 12. The trapezoidal surface portions 12 are bent successively or simultaneously along their median lines 13, so as to form the cooling fan blades 18 of the fan rotor 19, FIG. 2. The quadrilateral surface portions 11 join the successive cooling blades 18 together, so constituting linking surfaces or base webs.

Figure 2:
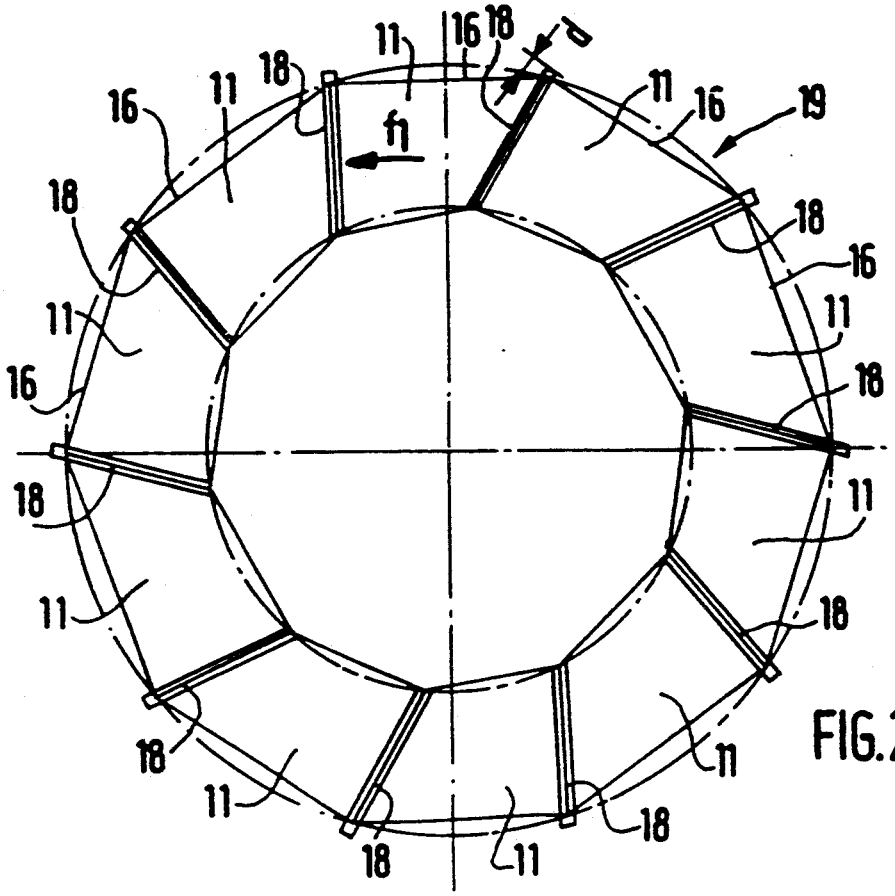
FIG. 2 is a top plan view of a cooling fan rotor made using the method of manufacture in accordance with the invention.

In this way, from a metal strip 10, a cooling fan rotor 19 is obtained with a profile in the shape of an irregular polygon having n sides, as can be seen in FIG. 2. Since the trapezoidal surface portions 12 have been bent, the junction between the two ends of the metal strip 10 is effected by any known means, for example by welding or riveting.

It will be noted in FIG. 2 that the cooling blades 18, formed in this way, are neither radial nor equidistant from each other, which enables the cooling fan rotor 19 to have an improved performance while at the same time reducing or even eliminating noise.

It will also be appreciated that the size of the blades may be increased, because this depends only on the unitary size of the trapezoidal surface portions 12. Similarly, the number of these surface portions 12 is no longer limited, because it only depends on the unitary size of the other quadrilateral surface portions 11.

Figure 3:
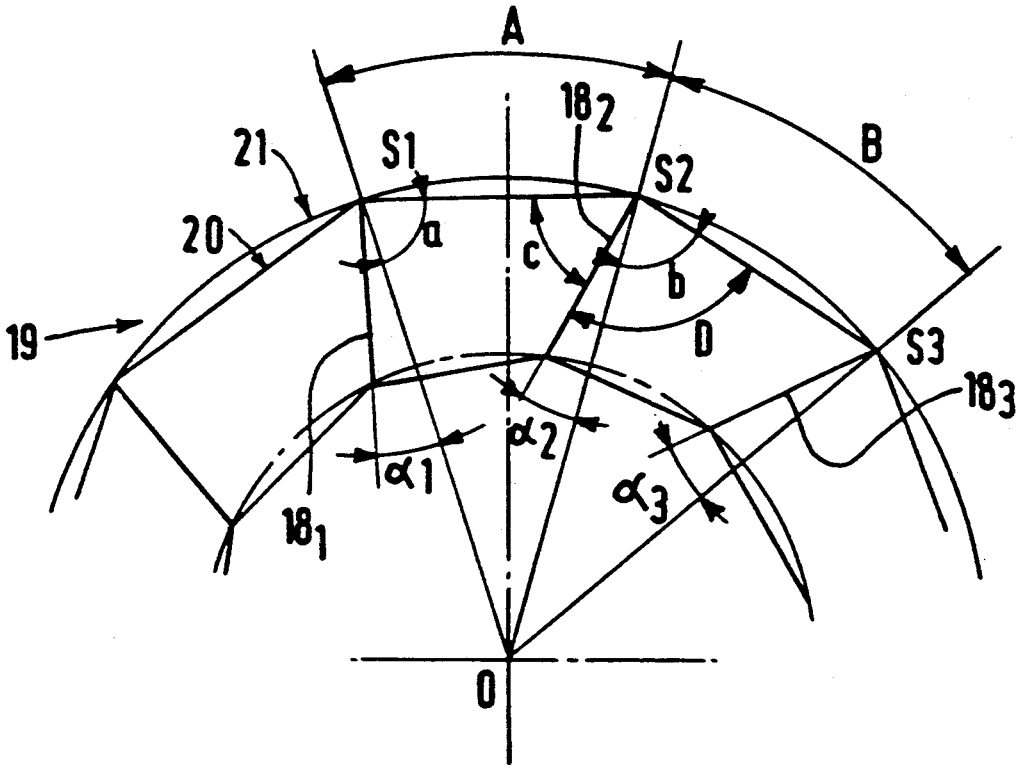
FIGS. 3 and 4 repeat parts of FIGS. 2 and 1 respectively, but show more specifically the angular features of a cooling fan rotor in accordance with the invention.

FIG. 3 is a partial view of the cooling fan rotor 19. As has already been explained, the outer profile 20 of the rotor is in the form of an irregular polygon, having apex points S1, S2, S3 etc. which together define a circle 21 having a centre O. The blades, here indicated at $18_1$, $18_2$, $18_3$ etc., define variable inclinations, i.e. different angles respectively, with respect to the corresponding radii OS1, OS2, OS2 etc. The respective angles are indicated at $\alpha 1$, $\alpha 2$. $\alpha 3$ etc. FIG. 3 also shows the respective angles A and B, subtended at the centre O, which correspond to the respective circumferential spacings between the apex points S1 and S2, and between the apex points S2 and S3.

If the rule of calculation of angles is applied in the isosceles triangles O-S1-S2 and O-S2-S3, then the base angle a of the triangle O-S1-S2 has a value a=90 degrees minus A/2, while the base angle b of the triangle O-S2-S3 has a value b=90 degrees minus B/2.

If C is then the angle between the blade $18_2$ and the side S1S2 of the polygon, and D is the angle between the blade $18_2$ and the side S2S3 of the polygon, then it follows that:

$$C=a-\alpha 2=90^\circ-A/2-\alpha 2$$

$$D=b+\alpha 2=90^\circ-B/2+\alpha 2$$

Figure 4:
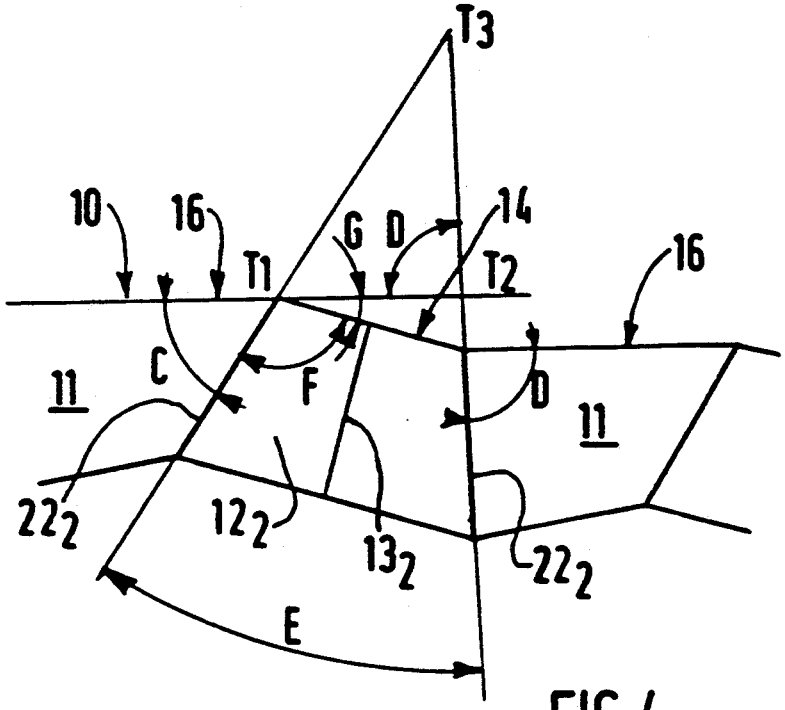

Reference is now made to FIG. 4, which shows part of the metal strip 10 with bending corresponding to the blade $18_2$ of FIG. 3. The sides $22_2$ of the trapezium of the surface portion $12_2$ define the angles C and D, the values of which are calculated above, with respect to the edges 16.

If E is the angle which is defined between the sides $22_2$ of the surface portion $12_2$, then application of the conventional rule for calculating angles in the triangle T1-T2-T3 gives the following relationship:

$$E=180^\circ-(C+D)$$

$$E=180^\circ-(90^\circ-A/2-\alpha 2+90^\circ-B/2+\alpha 2).$$

Hence, E=(A+B)/2. Similarly, for the angle F between the outer edge 14 and either side 22 of the surface portion 12, a value F=90 degrees+(A+B)/4 is obtained.

If G is the angle corresponding to the inclination of the outer edge 14 of the trapezoidal surface portion $12_2$ with respect to the outer edge 16 of the quadrilateral surface portion 11, then the angle G has a value of G=180 degrees minus (C+F). Hence, substituting the values for C and F obtained above:

$$G=180^\circ-90^\circ+A/2+\alpha 2-90^\circ-(A+B)/4$$

$$G=(A-B)/4+\alpha 2.$$

If it is required that successive edges 14 and 16 of the metal strip 10 are to form a straight line, then G must be zero, so that $(B-A)/4=\alpha 2$. However, this is only possible if A=B and $\alpha 2=0$ degrees. The successive edges 14 and 16 can thus only define a straight line if either: the blades 18 are equidistant from each other, i.e. A=B; or the blades 18 are radial, i.e. $\alpha 2=0$ degrees.

As has been explained above, FIG. 4 shows that the median line $13_2$ bisects the angle E defined by the sides $22_2$ of the surface portion $12_2$.

Figure 5:
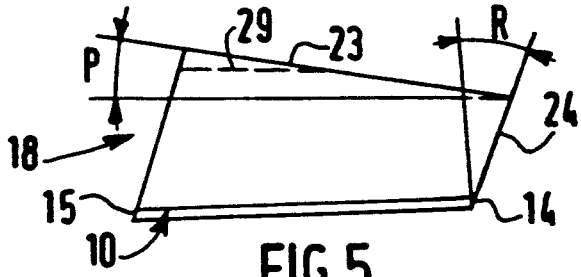
FIG. 5 is a side view seen in the direction of the arrow f1 in FIG. 2, showing a cooling blade.

Reference is now made in particular to FIG. 5, which shows a profile view of one cooling blade 18 which is made by the method of manufacture in accordance with the invention. The cooling blade 18 has an upper face 23 which makes an angle P with the horizontal, that is to say an angle P with respect to the base line 10 of the cooling fan rotor 19. The blade 18 also has an outer face 24 which makes an angle R with the vertical, that is to say perpendicular with the base 10 of the cooling fan rotor 19. The outer edge 24 of each cooling blade 18 therefore extends by a distance d (FIG. 2) beyond the polygonal profile defined by the edges 16 of the quadrilateral surface portions 11. Although this distance d is very small, it increases the overall diametral size of the cooling fan rotor 19, which may in certain cases be somewhat inconvenient.

Figure 6:
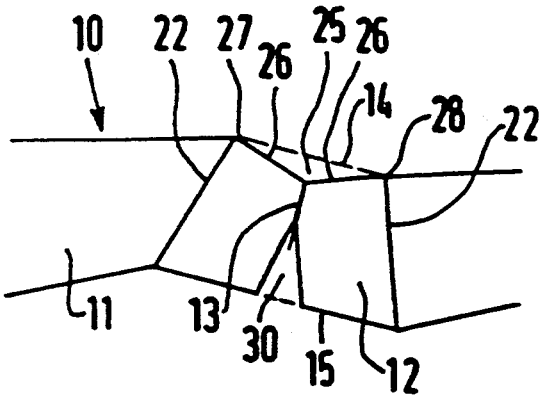
FIG. 6 is a view similar to part of FIG. 1, but shows alternative embodiments.

In order that the outer edge 24 of each ventilating blade 18 shall be vertical with respect to the base 10, thus eliminating the angle R and therefore the excess length d, V-shaped notches 25, as for example shown in FIG. 6, are formed in the metal strip 10 before any bending operation is carried out. Each V-shaped notch 25 has sides 26 which are symmetrical with respect to the associated median line 13, and which are perpendicular to the sides 22 of the trapezoidal surface portion 12 concerned, at the points of intersection 27 and 28 between the sides 22 and the outer edge 14 of the surface portion 12.

In addition, if it is required to eliminate the inclination P of the upper face 23 of each cooling fin 18 in FIG. 5, over a given length, a further V-shaped notch 30 (FIG. 6) is formed in the metal strip 10, in each surface portion 12, before any bending operation takes place. The V-shaped notch 30 is open in the outer edge 15 of the trapezoidal surface portion 12 and is symmetrical with the median line 13 of the other.

It will be self-evident that the V-shaped notches 25 and 30 are formed on all the trapezoidal surface portions 12, in such a way that all of the cooling blades 18 shall be identical with each other.

Figure 7:
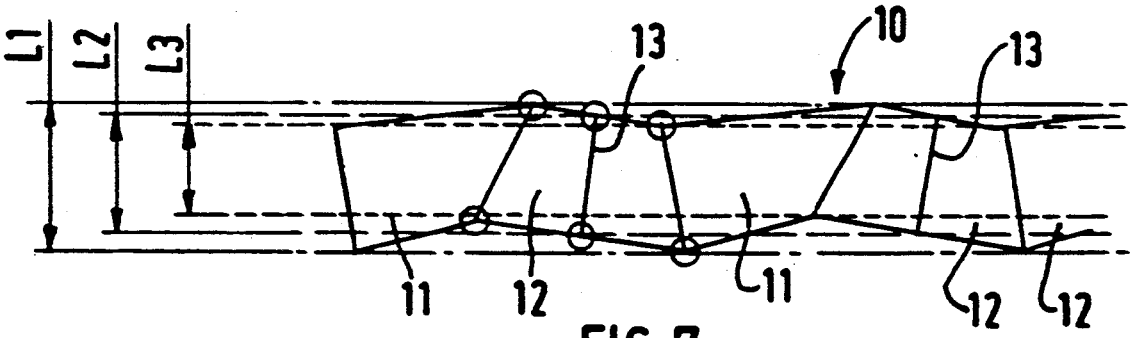
FIGS. 7 and 8 are similar to parts of FIGS. 1 and 2 respectively, and illustrate further embodiments.

As is shown in particular in FIG. 7, if the metal strip 10 is contained within a generally rectangular envelope of width L1, its outer edges are in the form of broken lines. Although an ideal cooling fan rotor can be constructed with such broken lines, there remains a difficulty for industrial manufacture of such a cooling fan rotor in an economic manner. In order to overcome this drawback, the metal strip 10 is cut straight on the widths L1, L2 and L3, for example as shown in FIG. 7.

Figure 9:
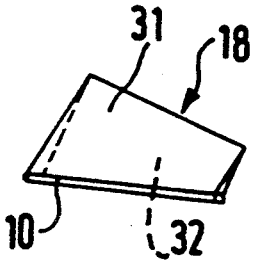
FIG. 9 is a view similar to FIG. 5, but is seen in the direction of the arrow f2 in FIG. 8.
Figure 8:
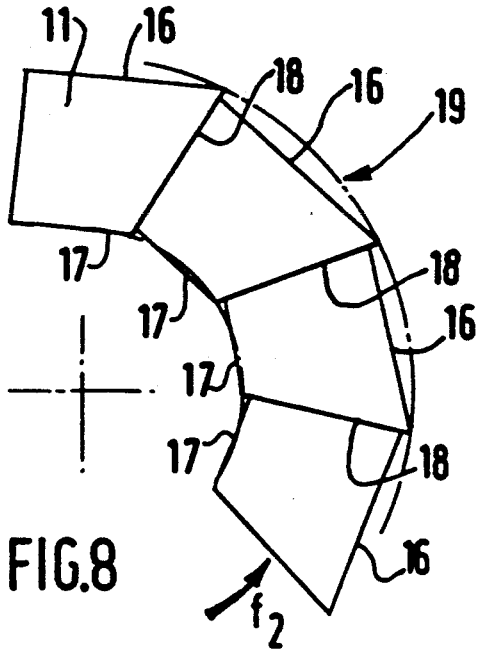

FIG. 8 shows diagrammatically a cooling fan rotor 19 which is obtained with a straight cut of the metal strip 10. It is seen in particular that the outer and inner contours of the polygon formed by the edges 16 and 17 of the quadrilateral surface portions 11 define discontinuities on the line of the cooling blades 18. In this configuration, as is shown in FIG. 9, the faces 31 and 32 of the cooling blades 18 no longer entirely overlap each other.

The present invention is of course in no way limited to the embodiments described above and shown in the drawings, but embraces any variant or modification within the spirit of the invention.

I claim:

1. A method of making a cooling fan rotor having n cooling blades for a rotary electrical machine, including the steps of:

forming an elongated metal strip (10);

forming the said metal strip with 2 n generally quadrilateral surface portions (11), comprising n first surface portions alternating with n second surface portions (12), each second surface portion being defined between two sides thereof in the form of boundary lines extending across the strip and inclined to each other by a first angle, the said first angle defining a median line of the corresponding second surface portion bisecting the first angle; and successively or simultaneously, bending each said second surface portion over on itself about its said median line (13).

2. A method according to claim 1, wherein each said second surface portion is made in the form of a trapezium.

3. A method according to claim 1, wherein the bending step is such that after the cooling blades have been thereby formed, the cooling fan rotor has a contour in the form of a polygon having apex points defining a circle, with each cooling blade defining an angle of inclination with a corresponding radius of the said circle, the said angle of inclination being variable as between one blade and another.

4. A method according to claim 3, wherein the apex points and therefore the cooling blades are spaced apart circumferentially by different amounts.

5. A method according to claim 1, in which each said second surface portion has an outer edge defining a point of intersection with each said boundary line of the surface portion, wherein the method includes the further step, prior to any operation of bending the second surface portions, of stamping out each of the latter to form a first notch having sides perpendicular to the said boundary lines at the said points of intersection.

6. A method according to claim 1, in which each said second surface portion has an inner edge, wherein the method includes the further step, prior to any operation of bending the said second surface portions, of stamping out each of the latter with a second V-shaped notch symmetrically with respect to the corresponding said median line, so that each second notch is open at the inner edge of the corresponding second surface portion.

7. A method according to claim 1, including the further step, prior to any bending operation, of performing a stamping operation to produce the metal strip in straight form.

8. A method according to claim 7, wherein the bending operation is such that the inner and outer contours of the polygon defined by free edges of the first quadrilateral surface portions define discontinuities in line with the cooling blades thereby formed.

9. A method according to claim 7, wherein the bending operation is such that the cooling blades define faces which partly overlap each other.

10. A cooling fan rotor having n cooling blades formed by a method according to any one of the preceding claims.

* * * * *